US007080612B2

(12) United States Patent
Satou et al.

(10) Patent No.: US 7,080,612 B2
(45) Date of Patent: Jul. 25, 2006

(54) CYLINDER BLOCK FOR INTERNAL COMBUSTION ENGINE

(75) Inventors: Naoyuki Satou, Akishima (JP); Fumiyuki Suzuki, Nagoya (JP)

(73) Assignees: Nissan Motor Co., Ltd., Yokohama (JP); Aichi Machine Industry Co., Ltd., Nagoya (JP)

( * ) Notice: Subject to any disclaimer, the term of this patent is extended or adjusted under 35 U.S.C. 154(b) by 14 days.

(21) Appl. No.: 10/954,199

(22) Filed: Oct. 1, 2004

(65) Prior Publication Data

US 2005/0263111 A1 Dec. 1, 2005

(30) Foreign Application Priority Data

Oct. 10, 2003 (JP) ..... 2003-351587

(51) Int. Cl.
*F02F 1/10* (2006.01)

(52) U.S. Cl. ..... 123/41.72; 123/41.74; 123/41.79

(58) Field of Classification Search ..... 123/41.72, 123/41.74, 41.79, 195 R
See application file for complete search history.

(56) References Cited

U.S. PATENT DOCUMENTS 4,517,945 A 5/1985 Ishigami et al.
5,988,120 A * 11/1999 Betsch et al. ..... 123/41.74
6,837,208 B1 * 1/2005 Satou ..... 123/195 R
2003/0172884 A1 * 9/2003 Laufenberg et al. ..... 123/41.72

FOREIGN PATENT DOCUMENTS

| | | | |
|---|---|---|---|
| DE | 3425797 | A1 | 1/1986 |
| DE | 4128208 | A1 | 3/1993 |
| EP | 0239997 | A | 10/1987 |
| EP | 0551805 | A1 | 7/1993 |
| JP | H02-125950 | A | 5/1990 |
| JP | H10-205389 | | 8/1998 |
| JP | 2002-161803 | A | 6/2002 |

* cited by examiner

*Primary Examiner*—Mahmoud Gimie
*Assistant Examiner*—Jason Benton
(74) *Attorney, Agent, or Firm*—Shinjyu Global IP Counselors

(57) ABSTRACT

A cylinder block for an internal combustion engine has a water jacket formed between cylindrically configured cylinder walls and a jacket sidewall. The cylinder walls is arranged to slideably retain pistons therein. The jacket sidewall is disposed around an external periphery of the cylinder walls. A pair of external block walls is provided on transverse sides of the cylinder block to extend almost an entire longitudinal length of the cylinder block. The external block walls are spaced apart from the jacket sidewall in a transverse direction to form gaps therebetween. The top end portions of the external block walls constitute an external flange portion of a top deck of the cylinder block. Thus, the rigidity of the top deck of the cylinder block is improved, and the sealing between the cylinder block and a cylinder head via a head gasket is improved.

19 Claims, 5 Drawing Sheets

CYLINDER BLOCK FOR INTERNAL COMBUSTION ENGINE

BACKGROUND OF THE INVENTION

1. Field of the Invention

The present invention relates to a cylinder block for a water-cooled internal combustion engine. More specifically, the present invention relates to a cylinder block in which a rigidity of a top deck is ensured by forming an external flange at the top deck of the cylinder block.

2. Background Information

Japanese Patent Application Laid-Open No. 2002-161803 describes a conventional cylinder block for a water-cooled internal combustion engine that includes a cylinder wall in which a plurality of pistons are disposed such that the pistons can reciprocate within the cylinder walls, and a jacket sidewall disposed in the periphery of the cylinder wall. In the conventional cylinder block disclosed in the above mentioned reference, a water jacket is formed between the cylinder wall and the jacket sidewall so that the heat is transferred from the cylinder wall to the coolant in the water jacket and the cylinder wall is cooled by the coolant circulating through the water jacket. In the conventional cylinder block, a cylinder head is fixedly coupled to the cylinder block by a plurality of head bolts with a head gasket disposed on a top deck of the cylinder block, and the water jacket of the cylinder block has an open end at the top deck of the cylinder block. A plurality of head bolt bosses in which the head bolts are threadably inserted are formed integrally in the jacket sidewall. Generally, in the conventional cylinder block, the jacket sidewall constitutes an external wall of the cylinder block, and thus, the top deck of the cylinder block has a two-layered flange structure consisting of a top end of the cylinder wall and a top end of the jacket sidewall.

In view of the above, it will be apparent to those skilled in the art from this disclosure that there exists a need for an improved cylinder block for an internal combustion engine. This invention addresses this need in the art as well as other needs, which will become apparent to those skilled in the art from this disclosure.

SUMMARY OF THE INVENTION

It has been discovered that in the conventional cylinder block as disclosed in the above mentioned reference, if the top deck of the cylinder block is collapsed or deformed by a spring force of a beaded section of the head gasket, sealing between the top deck of the cylinder block and the cylinder head will be adversely affected. In such case, a leakage of water and/or oil may occur. Therefore, the top deck of the cylinder block is required to have a sufficiently high strength and rigidity. However, it is difficult to ensure sufficient rigidity in the top deck of the cylinder block with a two-layered flange structure as in the conventional cylinder block described in the above mentioned reference.

Accordingly, one object of the present invention is to provide a cylinder block for an internal combustion engine in which the rigidity of the top deck of the cylinder block can be efficiently improved.

In order to achieve the above mentioned and other objects of the present invention, a cylinder block for an internal combustion engine having a top deck configured and arranged to be fixedly coupled to a cylinder head is provided that comprises a cylinder wall unit, a jacket sidewall, and first and second external block walls. The cylinder wall unit forming at least one cylinder bore is configured and arranged to slideably retain a piston in the at least one cylinder bore. The cylinder wall unit forms an inner flange portion of the top deck. The jacket sidewall surrounds an external periphery of the cylinder wall unit such that a water jacket is formed between the external periphery of the cylinder wall unit and an internal periphery of the jacket sidewall. The water jacket has an open end in the top deck. The jacket sidewall forms an intermediate flange portion of the top deck. The first and second external block walls extend substantially an entire longitudinal length of the cylinder block. The first and second external block walls are outwardly spaced apart from the jacket sidewall in a transverse direction of the cylinder block. The first and second external block walls form an external flange portion of the top deck.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiment of the present invention will now be explained with reference to the drawings. It will be apparent to those skilled in the art from this disclosure that the following descriptions of the embodiment of the present invention are provided for illustration only and not for the purpose of limiting the invention as defined by the appended claims and their equivalents.

Figure 1:
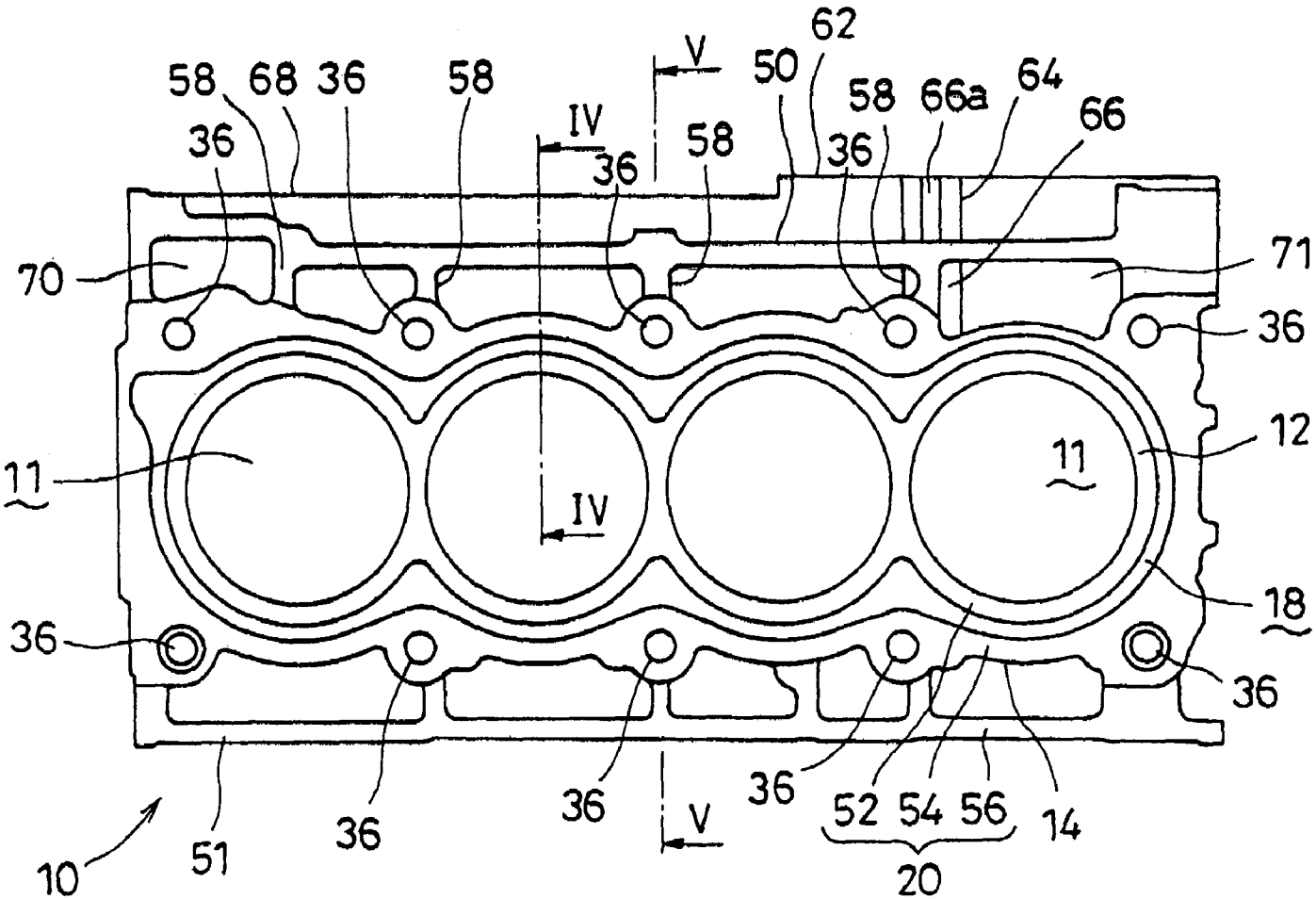
FIG. 1 is a top plan view of a cylinder block for an internal combustion engine in accordance with a preferred embodiment of the present invention.
Figure 2:
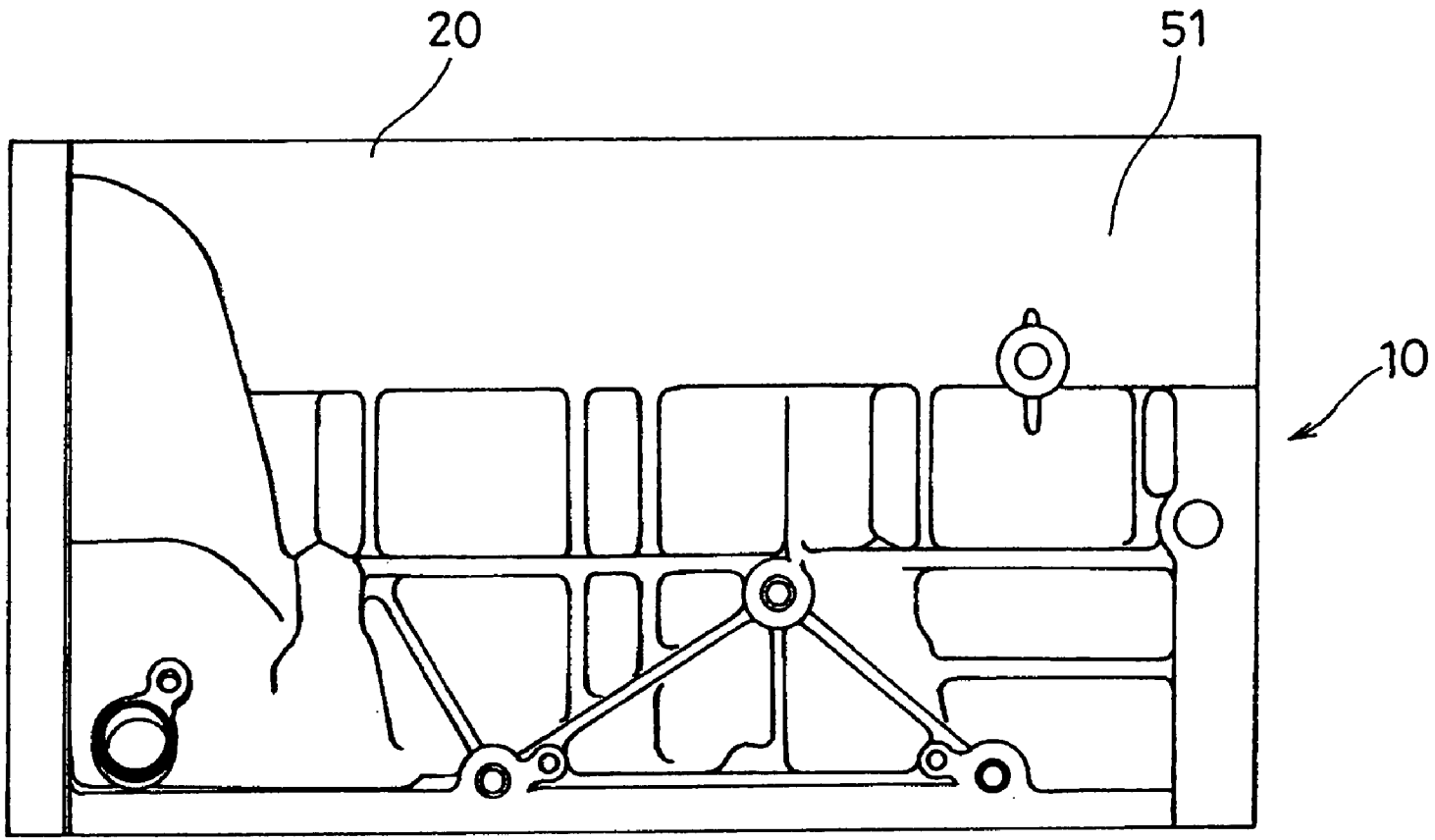
FIG. 2 is a rear side elevational view of the cylinder block illustrated in FIG. 1 in accordance with the present invention.
Figure 3:
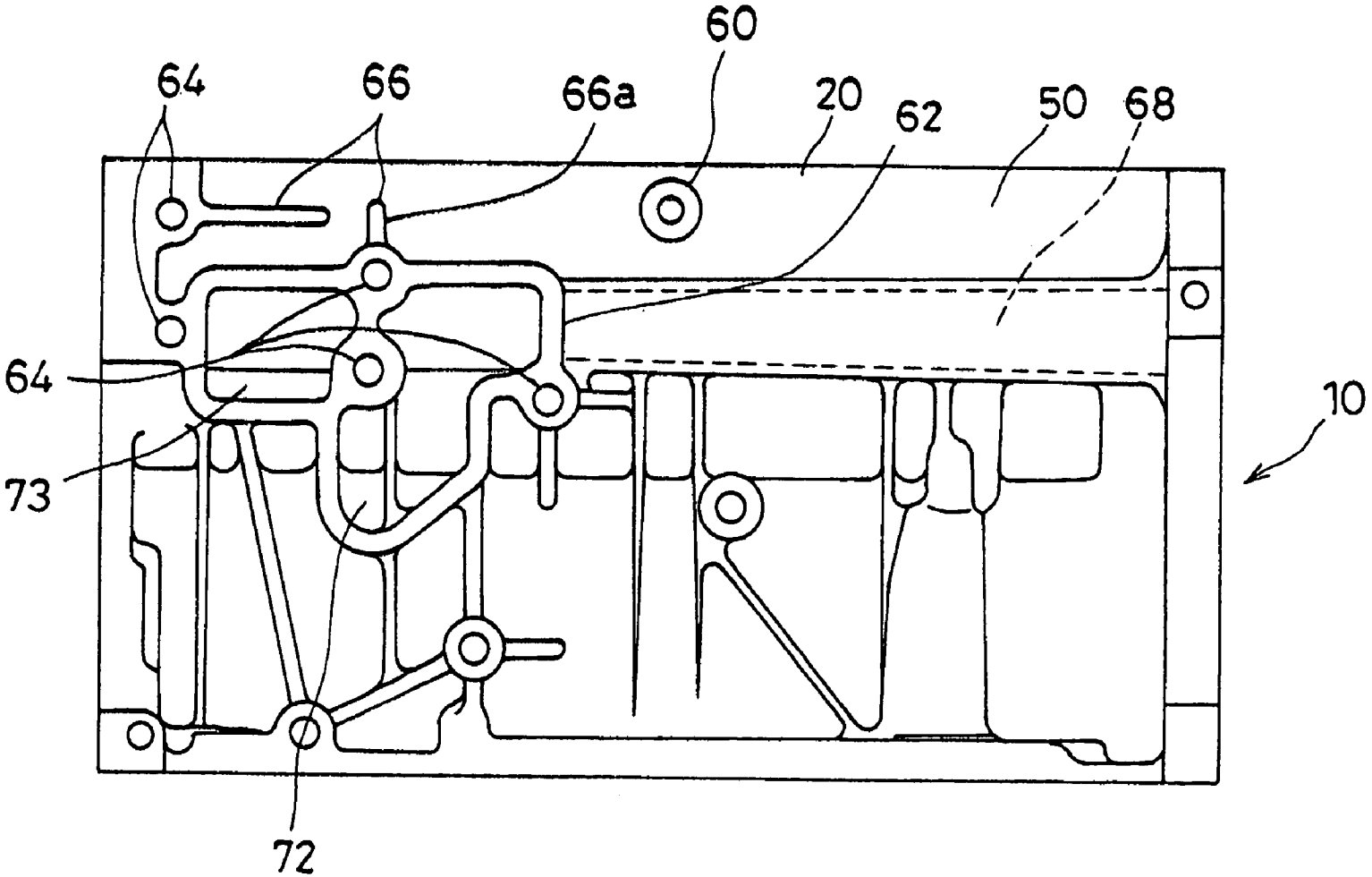
FIG. 3 is a front side elevational view of the cylinder block illustrated in FIGS. 1 and 2 in accordance with the present invention.
Figure 4:
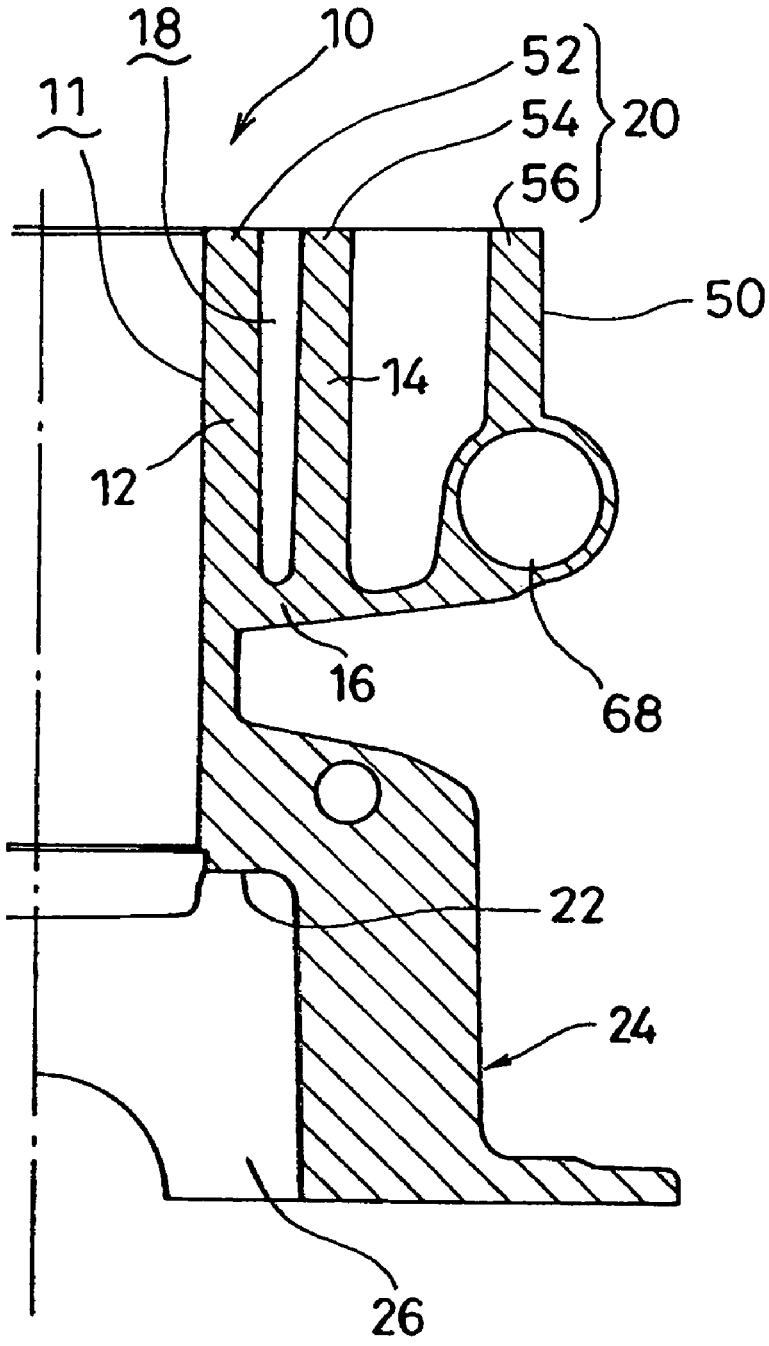
FIG. 4 is a partial cross sectional view of the cylinder block taken along a section line IV—IV in FIG. 1 in accordance with the present invention.
Figure 5:
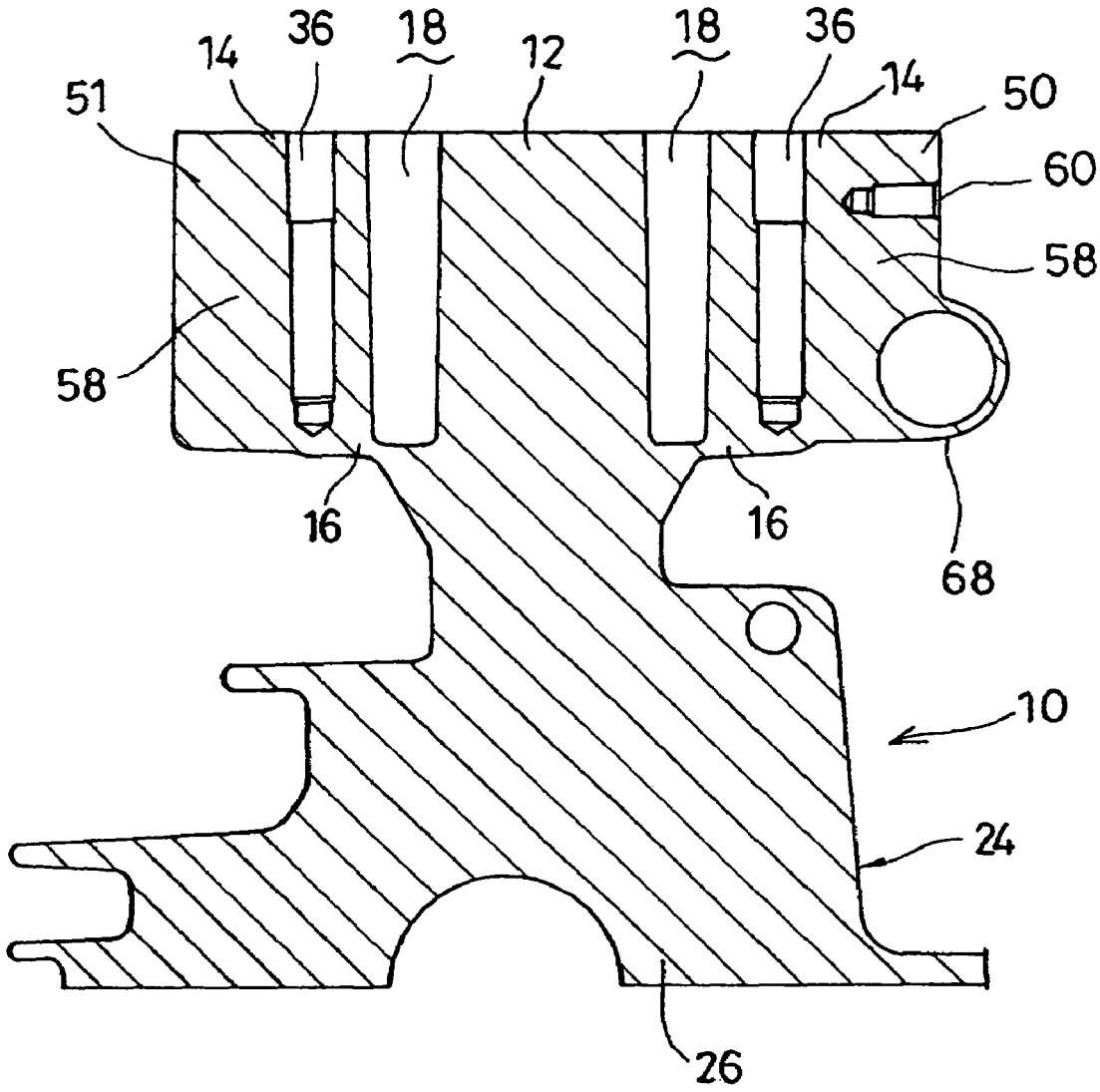
FIG. 5 is a cross sectional view of the cylinder block taken along a section line V—V in FIG. 1 in accordance with the present invention.

FIGS. 1 through 5 illustrate a cylinder block 10 for an internal combustion engine according to a preferred embodiment of the present invention. More specifically, FIG. 1 is a top plan view of the cylinder block 10. FIG. 2 is a rear side elevational view of the cylinder block 10. FIG. 3 is a front side elevational view of the cylinder block 10. FIG. 4 is a cross sectional view of the cylinder block 10 taken along a section line IV—IV in FIG. 1. FIG. 5 is a cross sectional view of the cylinder block 10 taken along a section line V—V in FIG. 1.

The cylinder block 10 is preferably configured and arranged to form an inline four-cylinder water-cooled internal combustion engine. The cylinder block 10 is preferably transversely mounted in a vehicle such that intake ports are arranged to be disposed at the front side of the vehicle (top direction in FIG. 1), and exhaust ports are arranged to be disposed at the rear side of the vehicle (bottom direction in FIG. 1). Of course, it will be apparent to those skilled in the art from this disclosure that the orientation of the cylinder block 10 with respect to the vehicle can vary depending on a design of the engine compartment and/or other various conditions.

The cylinder block 10 includes a top deck 20 disposed in a vertical upper portion of the cylinder block 10, and a lower deck 22 disposed in a vertical lower portion of the cylinder block 10. The top deck 20 of the cylinder block 10 is configured and arranged to be fixedly coupled to a cylinder head by a plurality of head bolts with a head gasket disposed therebetween. Also, the cylinder block 10 has a crank case 24 that is disposed underneath the lower deck 22. The top deck 20, the lower deck 22 and the crank case 24 of the cylinder block 10 are preferably integrally formed by aluminum die casting. The cylinder block 10 preferably has a so-called open deck configuration in which the top end of a water jacket 18, which is formed as a cast hole by die cast, opens wide in a top deck 20 of the cylinder block 10 as seen in FIG. 1. The cylinder block 10 preferably includes a plurality of cylinder walls 12 that are integrally formed to constitute a cylinder wall unit. Each of the cylinder walls 12 has a cylindrically configured cylinder bore 11. Each of the cylinder bores 11 is configured and arranged to retain a piston such that the piston can reciprocate therein. The cylinder block 10 also includes a jacket sidewall 14 formed along an external periphery of the cylinder walls 12 such that the water jacket 18 is formed between an upper portion of the external periphery of the cylinder walls 12 and the jacket sidewall 14. As well known in the prior art, the water jacket 18 is configured and arranged to transfer the heat from the cylinder walls 12 to the coolant in the water jacket 18 and cool the cylinder walls 12 by the coolant circulating through the water jacket 18.

In order to reduce a distance between the cylinder bores 11, the cylinder block 10 preferably has a so-called Siamese configuration in which portions of two adjacent cylinder walls 12 arranged in series in a column-wise direction are connected to each other as seen in FIG. 1. Each of the cylinder walls 12 preferably extends in a cylinder shape in the vertical direction of the cylinder block 10 between the top deck 20 and the lower deck 22 of the cylinder block 10 as seen in FIG. 4. Moreover, the cylinder block 10 is preferably provided with a plurality of bearing cap mounting parts 26 for rotatably supporting a bearing cap (not shown) and a crankshaft. The bearing cap mounting parts 26 are formed in the crank case 24 underneath the lower deck 22 of the cylinder block 10 to form the cylinder bore 11 as seen in FIG. 4.

As seen in FIGS. 4 and 5, a jacket bottom wall 16 is provided that forms a bottom surface of the water jacket 18 extending between a bottom end of the jacket sidewall 14 and a vertical middle portion of the cylinder walls 12. The water jacket 18 of the cylinder block 10 is formed so that the water jacket 18 is disposed only at a top periphery portion of the cylinder walls 12. In other words, the jacket bottom wall 16 is preferably disposed relatively higher up in a vertical direction of the cylinder block 10 than the lower deck 22 of the cylinder block 10 such that a depth of the water jacket 18 is relatively shallow. As a result, the top portion of each of the cylinder walls 12 that is adjacent to a combustion chamber can be efficiently cooled by the coolant in the water jacket 18 while the lower periphery portion of the cylinder walls 12 to which the jacket sidewall 14 is not provided can be made more lightweight. Accordingly, an excessive cooling can be prevented, and fuel consumption, exhaust, heater properties, and the like can be improved.

The cylinder block 10 further includes a pair of external block walls 50 and 51 that extend in a longitudinal direction of the cylinder block 10 at front and rear sides of the cylinder block 10, respectively. More specifically, the external block wall 50 is disposed on the intake side in an outward direction with respect to the jacket sidewall 14, and the external block wall 51 is disposed on the exhaust side in an outward direction with respect to the jacket sidewall 14 as seen in FIG. 1. The external block walls 50 and 51 are preferably integrally formed with the jacket sidewall 14 and spaced apart from the jacket sidewall 14 for prescribed distances in a transverse direction of the cylinder block 10. The external block walls 50 and 51 preferably extend across substantially the entire length of the cylinder block 10 in the longitudinal direction of the cylinder block 10. Thus, the external block walls 50 and 51 preferably constitute a pair of external flanges at the front and rear sides of the top deck 20 of the cylinder block 10.

Accordingly, in cylinder block 10 of the present invention, the top deck 20 consists of a three-layered flange structure having a top end portion of the cylinder walls 12 constituting an inside flange portion 52, a top end portion of the jacket side wall 14 constituting a intermediate flange portion 54, and top end portions of the external block walls 50 and 51 constituting an external flange portion 56. Therefore, the rigidity of the top deck 20 of the cylinder block 10 can be efficiently improved compared with the conventional cylinder block having a top deck with a two-layered flange structure such as the one previously described. Therefore, the top deck 20 can be adequately prevented from being collapsed or deformed by the spring force of the beaded section of the head gasket or the like. As a result, the sealing between the cylinder head and the cylinder block 10 can be improved when the cylinder head is mounted to the cylinder block 10 with the head gasket disposed therebetween, and deformation of the cylinder walls 12, and the fuel leakage and the like resulting from the deformation of the cylinder walls 12 can be reliably prevented. Moreover, deformation of the jacket sidewall 14, and the water leakage, oil leakage, or the like resulting from the deformation of the jacket sidewall 14 can be reliably prevented.

Moreover, as seen in FIGS. 1 and 3, the cylinder block 10 is preferably provided with a substantially cylindrical sensor-mounting boss 60 configured and arranged to fixedly couple a nock sensor or the like to the cylinder block 10. As seen in FIGS. 3 and 5, the sensor-mounting boss 60 is preferably formed integrally with the external block wall 50 and one side of the jacket sidewall 14.

Furthermore, as shown in FIGS. 1 and 5, the jacket sidewall 14 of the cylinder block 10 preferably includes a plurality of head bolt bosses 36 disposed intermittently at the four corners of each of the cylinder bores 11 in which the above mentioned head bolts are fitted or threadably inserted for fixedly coupling the cylinder head to the top deck 20 of the cylinder block 10. As shown in FIG. 5, each of the head bolt bosses 36 preferably extends from the top deck 20 to the jacket bottom wall 16 in the vertical direction of the cylinder block 10. More specifically, the jacket sidewall 14 is thickened in a substantially cylindrical shape and is extended outwardly toward one side of the cylinder block 10 in the areas where the head bolt bosses 36 are formed. Moreover, each of the head bolt bosses 36 on the jacket sidewall 14 and the external block wall 50 or 51 are integrally connected by a plurality of external wall connecting ribs 58 as seen in FIG. 1. In other words, each of the external wall connecting ribs 58 extends between corresponding one of the head bolt bosses 36 formed in the thickened, highly rigid portions of the jacket sidewall 14 and the external block wall 50 or 51. With the external wall connecting ribs 58, the rigidity of the external block walls 50 and 51 can be efficiently increased with a simple configuration that utilizes the head bolt bosses 36. Moreover, knockings occurred in the cylinder bores 11 are readily transmitted through the external wall connecting ribs 58 and the external block wall 50 or 51 to the sensor-mounting boss 60, and thus, the precision for detecting knocking is improved.

The external block walls 50 and 51 preferably include an auxiliary device mounting flange 62 for mounting a water pump or other such auxiliary devices as seen in FIGS. 1 and 3. A plurality of substantially cylindrically shaped auxiliary device mounting bosses 64 for accommodating a plurality of auxiliary device mounting bolts for fixedly coupling the water pump or other auxiliary devices are intermittently formed in the auxiliary device mounting flange 62. Moreover, a plurality of reinforcing ribs 66 preferably extend between the external peripheries of the auxiliary device mounting bosses 64 for reinforcing the auxiliary device mounting bosses 64 as seen in FIG. 3. At least one of the reinforcing ribs 66 preferably includes a rib portion 66*a* that extends in the transverse direction of the cylinder block 10 from the corresponding one of the reinforcing ribs 66 to the external block wall 50 and to corresponding one of the head bolt bosses 36 formed in the jacket sidewall 14 in a straight line, as shown in FIG. 1. In other words, the rib portion 66*a* of one of the reinforcing ribs 66 is integrally formed with the external wall connecting rib 58 such that the external wall connecting rib 58 is extended outwardly. Thus, the rigidity of the auxiliary device mounting bosses 64 can be further efficiently improved by the rib portion 66*a* of the at least one of the reinforcing ribs 66. Moreover, since the rib portion 66*a* is formed on an extension of the external wall connecting rib 58 and the external wall connecting rib 58 and the rib portion 66*a* are integrally formed, the weight of the cylinder block 10 can be reduced and the necessary rigidity of the cylinder block 10 can be ensured.

As seen in FIGS. 4 and 5, the cylinder block 10 preferably further includes a water pipe 68 for circulating the coolant. The water pipe 68 is preferably integrally formed in a region in which the external block wall 50 (intake side) is coupled to the jacket bottom wall 16. The water pipe 68 is formed to extend across almost the entire longitudinal length of the cylinder block 10, and one end of the water pipe 68 is an open end formed preferably as a cast hole. The water pipe 68 is disposed in the region in which the external block wall 50 connects with the jacket sidewall 14. In other words, the external block wall 50 and the jacket sidewall 14 are integrally coupled to the water pipe 68. Since the water pipe 68 is integrally formed with the cylinder block 10 as described above, the number of pipe mounting brackets and other such parts can be reduced, the weight of the cylinder block 10 can be reduced, and the width of an assembly of the cylinder block 10 can be shortened in the transverse direction compared to when a separate water pipe is fixed to the cylinder block 10. Moreover, although it is usually difficult to ensure good metal circulation during casting when the water pipe 68 has a thin wall and is positioned relatively far from the center of the cylinder block 10, since a comparatively thick external block wall 50 rising from the external periphery of the water pipe 68 extends in the longitudinal direction of the cylinder block 10 in the present embodiment, metal circulating properties are improved. Thus, the cylinder block 10 including the water pipe 68 can be efficiently manufactured by die cast.

As seen in FIG. 1, the cylinder block 10 further includes coolant channels 70 and 71 for passing the coolant. The coolant channels 70 and 71 are preferably formed between the jacket sidewall 14 and the external block wall 50. More specifically, the coolant channels 70 and 71 include open ends at the top deck 20 and configured and arranged to be fluidly coupled to a water jacket formed in the cylinder head when the cylinder head is mounted to the top deck 20 of the cylinder block 10 with the head gasket disposed therebetween. Thus, the coolant channels 70 and 71 are formed by efficiently utilizing the gaps between the jacket sidewall 14 and the external block wall 50. Thus, the cylinder block 10 can be further made compact and lightweight.

Also, as seen in FIG. 3, two coolant ducts 72 and 73 are preferably formed to open in the auxiliary device mounting flange 62. The coolant channels 70 and 71, the coolant ducts 72 and 73, and the water pipe 68 are integrally formed and fluidly coupled together inside the cylinder block 10. Therefore, no seal members or connecting members are needed for coupling these members, the coolant circuits can be simplified, and the cylinder block 10 can be made lightweight.

Accordingly, with the cylinder block 10 of the present invention, the external flange portion of the top deck 20 is formed by the external block walls 50 and 51 that are spaced apart outwardly from the jacket sidewall 14 by a prescribed distance. In other words, the top deck 20 has a three-layered flange structure comprising the top end portion of the cylinder walls 12 that constitutes the inner wall flange portion 52, the top end portion of the jacket sidewall 14 that constitutes the intermediate flange portion 54, and the external block walls 50 and 51 that constitute the external wall flange portion 56. Therefore, the rigidity of the top deck 20 can be increased. Especially, the undesirable flexure or deformation of the top deck 20 caused by the spring force of the beaded section of the head gasket can be efficiently reduced or prevented.

While only selected embodiment has been chosen to illustrate the present invention, it will be apparent to those skilled in the art from this disclosure that various changes and modifications can be made herein without departing from the scope of the invention as defined in the appended claims. For example, the structure of the cylinder block 10 is not limited to the one in which the external block walls 50 and 51 on the intake and exhaust sides, respectively, extend between the top deck 20 to the jacket bottom wall 16 in the vertical direction of the cylinder block 10 as in the embodiment described above. For example, the height of the external block walls 50 and 51 may be reduced and the external block walls 50 and 51 may be configured and arranged to extend in the vertical direction of the cylinder block only in the area near the top deck 20 to form the external flange portion 56.

As used herein, the following directional terms "forward, rearward, above, downward, vertical, horizontal, below and transverse" as well as any other similar directional terms refer to those directions of a vehicle equipped with the present invention. Accordingly, these terms, as utilized to describe the present invention should be interpreted relative to a vehicle equipped with the present invention.

The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

This application claims priority to Japanese Patent Application No. 2003-351587. The entire disclosure of Japanese Patent Application No. 2003-351587 is hereby incorporated herein by reference.

Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. A cylinder block for an internal combustion engine having a top deck configured and arranged to be fixedly coupled to a cylinder head, comprising:

a cylinder wall unit forming at least one cylinder bore configured and arranged to slideably retain a piston in the at least one cylinder bore, the cylinder wall unit forming an inner flange portion of the top deck;

a jacket sidewall continuously surrounding an external periphery of the cylinder wall unit such that a water jacket is formed between the external periphery of the cylinder wall unit and an internal periphery of the jacket sidewall, the water jacket having a continuous open end in the top deck surrounding the cylinder wall unit, the jacket sidewall forming an intermediate flange portion of the top deck; and first and second external block walls extending substantially an entire longitudinal length of the cylinder block, the first and second external block walls being outwardly spaced apart from the jacket sidewall in a transverse direction of the cylinder block, the first and second external block walls forming an external flange portion of the top deck, the first and second external block walls including a plurality of connecting ribs connecting the first and second external block walls to the jacket sidewall.

2. The cylinder block according to claim 1, wherein the jacket sidewall includes a plurality of head bolt bosses configured and arranged to fixedly couple the cylinder head to the top deck, and each of the connecting ribs of the first and second external block walls connects corresponding one of the head bolt bosses of the jacket sidewall to corresponding one of the first and second external block walls.

3. A cylinder block for an internal combustion engine having a top deck configured and arranged to be fixedly coupled to a cylinder head, comprising:

a cylinder wall unit forming at least one cylinder bore configured and arranged to slideably retain a piston in the at least one cylinder bore, the cylinder wall unit forming an inner flange portion of the top deck;

a jacket sidewall surrounding an external periphery of the cylinder wall unit such that a water jacket is formed between the external periphery of the cylinder wall unit and an internal periphery of the jacket sidewall, the water jacket having an open end in the top deck, the jacket sidewall forming an intermediate flange portion of the top deck, the jacket sidewall including a plurality of head bolt bosses configured and arranged to fixedly couple the cylinder head to the top deck; and first and second external block walls extending substantially an entire longitudinal length of the cylinder block, the first and second external block walls being outwardly spaced apart from the jacket sidewall in a transverse direction of the cylinder block, the first and second external block walls forming an external flange portion of the top deck, the first and second external block walls including a plurality of connecting ribs, each of the connecting ribs connecting corresponding one of the head bolt bosses of the jacket sidewall to corresponding one of the first and second external block walls, at least one of the first and second external block walls including a sensor-mounting boss configured and arranged to fixedly couple a knock sensor to the cylinder block.

4. A cylinder block for an internal combustion engine having a top deck configured and arranged to be fixedly coupled to a cylinder head, comprising:

a cylinder wall unit forming at least one cylinder bore configured and arranged to slideably retain a piston in the at least one cylinder bore, the cylinder wall unit forming an inner flange portion of the top deck;

a jacket sidewall surrounding an external periphery of the cylinder wall unit such that a water jacket is formed between the external periphery of the cylinder wall unit and an internal periphery of the jacket sidewall, the water jacket having an open end in the top deck, the jacket sidewall forming an intermediate flange portion of the top deck;

first and second external block walls extending substantially an entire longitudinal length of the cylinder block, the first and second external block walls being outwardly spaced apart from the jacket sidewall in a transverse direction of the cylinder block, the first and second external block walls forming an external flange portion of the top deck; and a jacket bottom wall connecting a portion of the external periphery of the cylinder wall unit, a bottom end of the jacket sidewall, and bottom ends of the first and second external block walls.

5. The cylinder block according to claim 3, further comprising a jacket bottom wall connecting a portion of the external periphery of the cylinder wall unit, a bottom end of the jacket sidewall, and bottom ends of the first and second external block walls.

6. The cylinder block according to claim 4, wherein one of the first and second external block walls and the jacket bottom wall are coupled together to integrally form a water pipe therebetween that extends in a longitudinal direction of the cylinder block.

7. The cylinder block according to claim 5, wherein one of the first and second external block walls and the jacket bottom wall are coupled together to integrally form a water pipe therebetween that extends in a longitudinal direction of the cylinder block.

8. A cylinder block for an internal combustion engine having a top deck configured and arranged to be fixedly coupled to a cylinder head, comprising:

a cylinder wall unit forming at least one cylinder bore configured and arranged to slideably retain a piston in the at least one cylinder bore, the cylinder wall unit forming an inner flange portion of the top deck;

a jacket sidewall surrounding an external periphery of the cylinder wall unit such that a water jacket is formed between the external periphery of the cylinder wall unit and an internal periphery of the jacket sidewall, the water jacket having an open end in the top deck, the jacket sidewall forming an intermediate flange portion of the top deck;

first and second external block walls extending substantially an entire longitudinal length of the cylinder block, the first and second external block walls being outwardly spaced apart from the jacket sidewall in a transverse direction of the cylinder block, the first and second external block walls forming an external flange portion of the top deck;

at least one auxiliary device mounting boss formed on one of the first and second external block walls; and at least one reinforcing rib connected to the at least one auxiliary device mounting boss and extending to the one of the first and second external block walls and to the jacket sidewall.

9. The cylinder block according to claim 7 further comprising at least one auxiliary device mounting boss formed on one of the first and second external block walls, and at least one reinforcing rib connected to the at least one auxiliary device mounting boss and extending to the one of the first and second external block walls and to the jacket sidewall.

10. The cylinder block according to claim 1, wherein the jacket sidewall and one of the first and second external block walls are arranged to form at least one coolant channel therebetween.

11. The cylinder block according to claim 6, wherein the jacket sidewall and the one of the first and second external block walls are arranged to form at least one coolant channel therebetween.

12. The cylinder block according to claim 11, wherein the at least one coolant channel is fluidly coupled to the water pipe.

13. The cylinder block according to claim 6, further comprising a plurality of auxiliary device mounting bosses formed on the one of the first and second external block walls, and a plurality of reinforcing ribs extending between the auxiliary device mounting bosses for reinforcing the auxiliary device mounting bosses.

14. The cylinder block according to claim 13, wherein at least one of the reinforcing ribs includes a rib portion connected to one of the auxiliary device mounting bosses and extending to the one of the first and second external block walls and to the jacket side wall.

15. The cylinder block according to claim 13, wherein the reinforcing ribs are arranged to form at least one coolant duct that is fluidly coupled to the water pipe.

16. A cylinder block for an internal combustion engine having a top deck configured and arranged to be fixedly coupled to a cylinder head, comprising:

inner cylinder head support means for forming an inner support portion of the top deck and forming at least one cylinder bore configured and arranged to slideably retain a piston in the at least one cylinder bore;

intermediate cylinder head support means for forming an intermediate support portion of the top deck continuously surrounding an external periphery of the inner cylinder head support means such that a water jacket is formed between the external periphery of the inner cylinder head support means and an internal periphery of the inner cylinder head support means as the water jacket having a continuous open end in the top deck surrounding the inner cylinder head support means;

external cylinder head support means for forming an external support portion of the top deck extending substantially an entire longitudinal length of the cylinder block on longitudinal sides of the cylinder block that is spaced outwardly apart from the intermediate cylinder head support means; and connecting means for fixedly connecting the external cylinder head support means to the intermediate cylinder head support means.

17. The cylinder block according to claim 1, further comprising a jacket bottom wall connecting a portion of the external periphery of the cylinder wall unit, a bottom end of the jacket sidewall, and bottom ends of the first and second external block walls.

18. The cylinder block according to claim 17, wherein one of the first and second external block walls and the jacket bottom wall are coupled together to integrally form a water pipe therebetween that extends in a longitudinal direction of the cylinder block.

19. The cylinder block according to claim 18, wherein the jacket sidewall and the one of the first and second external block walls are arranged to form at least one coolant channel therebetween.

* * * * *